United States Patent [19]

Janetzke et al.

[11] Patent Number: 4,658,783

[45] Date of Patent: Apr. 21, 1987

[54] SYSTEM FOR REGULATING ROTARY SPEED OF AN INTERNAL COMBUSTION ENGINE

[75] Inventors: Helmut Janetzke; Helmut Kauff, both of Schwieberdingen; Herbert Stocker, Leonberg, all of Fed. Rep. of Germany

[73] Assignee: Robert Bosch GmbH, Stuttgart, Fed. Rep. of Germany

[21] Appl. No.: 825,790

[22] Filed: Feb. 4, 1986

Related U.S. Application Data

[63] Continuation of Ser. No. 497,732, May 24, 1983, abandoned.

[30] Foreign Application Priority Data

Jun. 15, 1982 [DE] Fed. Rep. of Germany ..... 3222363

[51] Int. Cl.[4] ..... F02D 41/16

[52] U.S. Cl. ..... 123/339; 123/340; 123/352

[58] Field of Search ..... 123/339, 340, 341, 352, 123/587

[56] References Cited

U.S. PATENT DOCUMENTS

| | | | |
|---|---|---|---|
| 3,964,457 | 6/1976 | Coscia | 123/339 |
| 4,237,838 | 12/1980 | Kinugawa et al. | 123/339 |
| 4,305,360 | 12/1981 | Meyer et al. | 123/339 |
| 4,385,603 | 5/1983 | Bonse et al. | 123/339 |
| 4,418,665 | 12/1983 | Nagase | 123/339 |
| 4,441,471 | 4/1984 | Kratt et al. | 123/339 |

FOREIGN PATENT DOCUMENTS

| | | | |
|---|---|---|---|
| 58-57037 | 4/1983 | Japan | 123/352 |

*Primary Examiner*—Andrew M. Dolinar
*Attorney, Agent, or Firm*—Michael J. Striker

[57] ABSTRACT

A regulator for no-load speeds of an internal combustion engine is disclosed. The regulator includes an input for the actual and desired rotary speed signals and an additional input for a signal corresponding to the load of the engine. The compound regulating signal at the output of the regulator is applied to adjusting means for the fuel mixture supply.

2 Claims, 6 Drawing Figures

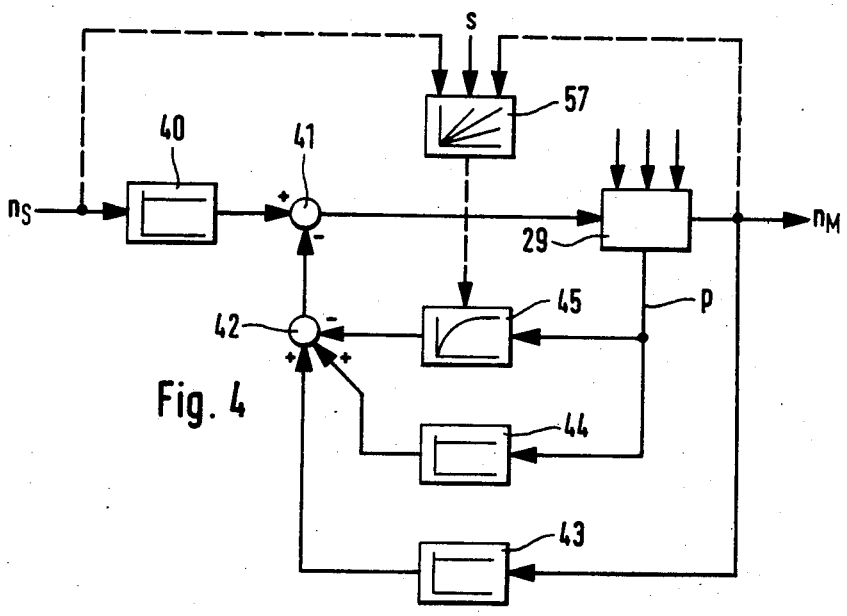
Fig. 4
Fig. 5
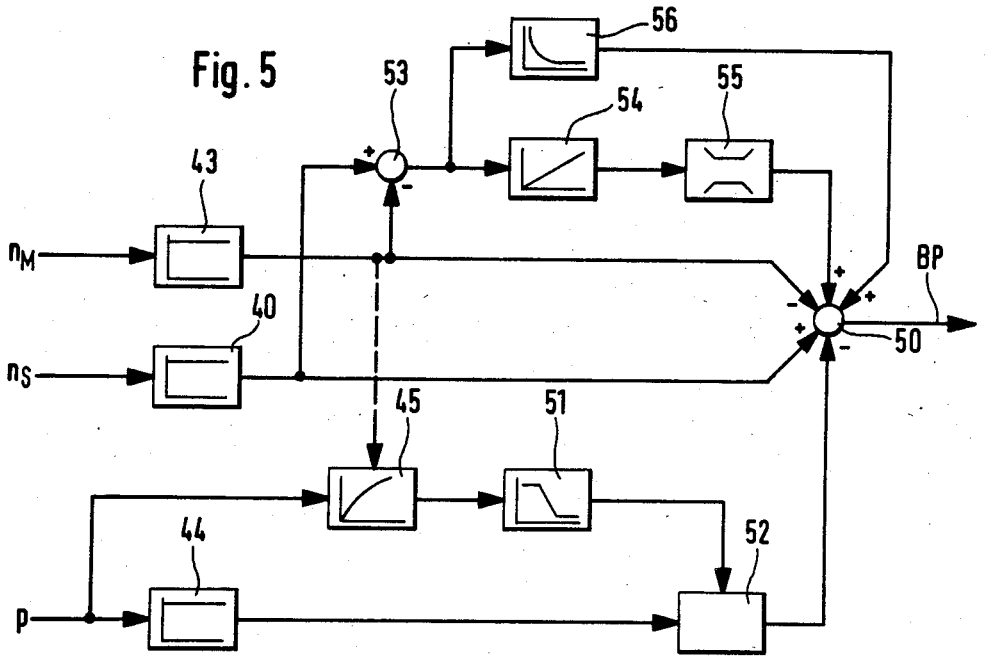

SYSTEM FOR REGULATING ROTARY SPEED OF AN INTERNAL COMBUSTION ENGINE

This application is a continuation of application Ser. No. 497,732, filed May 24, 1983, now abandoned.

BACKGROUND OF THE INVENTION

The present invention relates in general to a rotary speed regulating system, particularly for regulating the idling speed of an internal combustion engine. The system includes a generator for producing a desired-value signal, a sensor for sensing the actual speed value, a regulator responsive to the desired and actual speed values, and a fuel mixture adjuster responsive to the output signal from the regulator.

Arrangements are known from prior art which regulate the rotary speed of internal combustion engines, especially in motor vehicles. Of particular interest are the arrangements for regulating the no-load or idling speed of the engine, because if a motor vehicle is equipped with connectable and disconnectable consumers then, when the engine is idling, a strong reduction of its rotary speed, or even a stoppage, may occur when such a consumer is suddenly switched on. For example, when in a standing motor vehicle with running motor an air conditioner, or an automatic shifting device, or a power steering device, or the like, is suddenly activated, the aforementioned drop in the rotary speed will take place. In an unregulated IC engine, the total load may be so large that the engine stalls. In addition, in the endeavor to save energy it is desirable to set the engine for lowest idling speed. A no-load speed regulation of this kind is therefore of importance, both for fitting up the engine and for special operation conditions such as for idling speeds and the like.

For regulating idling speeds, it has been known to employ conventional P-, PI- or PID-regulators. In those regulators, the operation is based generally on the detection of the deviation of the actual rotary speed of the engine from the desired one. Such a known arrangement is described, for example, in U.S. Pat. No. 3,661,131. The disadvantage of such prior-art speed regulators is in a relatively slow response, because the rotary speed increase or decrease is the last effect of varying operational conditions. As a consequence, the prior-art regulating systems cannot distinguish different operational conditions. For example, a conventional speed regulator cannot distinguish whether a motor vehicle is stationary during idling or whether it slowly moves. In the latter case, the regulator permits the speed drop up to a zero value, so that a fuel mixture adjuster, usually a bypass valve associated with a throttle valve, is completely closed. Due to the relatively high rotary speed of the engine during the slow pull-up movement of the motor vehicle, the fuel mixture in the intake manifold is completely sucked up by the engine. If the operator during this pull-up operation steps on the clutch and if a larger consumer, such as an air conditioner is on, then in spite of immediate opening of the fuel mixture adjuster the dynamic behavior of the rotary speed regulation has hardly any effect, inasmuch as the intake pipe or manifold must first be filled up. This delay is manifested in a strong subharmonic oscillation of the course of the rotary speed, which under certain circumstances may lead to stalling of the engine when it falls below its running limit. Under this particular operational condition, a conventional idling speed regulation of the engine is proved as disadvantageous in comparison with unregulated engines, inasmuch as in the latter case always a certain amount of residual air is supplied through the idling speed setting propeller, and the intake manifold is not completely empty. This aforementioned disadvantageous operational condition of the idling internal combustion engine may occur also in motor vehicles with automatic transmissions when a vehicle during its slow pull-up movement is suddenly braked. In this case a reverse shift is introduced in the gear control, due to the sinking speed of movement, and a positive coupling between the engine and the gears is momentarily interrupted.

From the publication WO-A1-81/01591, it is known how to employ the suction pressure of the internal combustion engine for regulating its idling speed. This known device, however, employs the suction pressure only, and consequently an exact maintenance of the idling speed is not guaranteed, and especially a predetermined desired value of the rotary speed cannot be obtained.

SUMMARY OF THE INVENTION

It is therefore a general object of the present invention to overcome the aforementioned disadvantages.

More particularly, it is an object of the invention to provide an improved idling speed regulator for IC engines which optimizes the speed regulation of the driving unit in such a manner that an exact idling speed regulation, both during the stationary operational condition and during the pull-up of the vehicle, is made possible.

Another object of this invention is to save fuel and to reduce the emission of pollutants.

An additional object of the invention is to provide such an improved regulating system which reliably prevents stalling of the engine, even if large power consumers are switched on during the idling condition.

In keeping with these objects and others which will become apparent hereafter, one feature of the invention resides in the regulating system of the aforedescribed kind, in the provision of an additional sensor for measuring load of the engine, designing the speed regulator as a condition regulator which is responsive to the desired and actual speed values and to the load of the engine to produce a compound regulating signal and rotary speed adjusting means responsive to the compound regulating signal.

Since the condition regulator in producing the compound output signal takes into account not only the difference between the desired and actual rotary speed values but also the load of the engine, it makes it possible to provide an exact regulation of the idling speed of the engine and preventing the stalling of the latter even if power consuming appliances are suddenly switched on.

The regulation at the same time is independent from the design of the adjusting means for the fuel mixture during the idling of the engine. In other words, the invention can be employed both in bypass valve type and in electrically controlled throttle valves of the adjusting means.

Particularly advantageous is the embodiment of the condition regulator according to this invention in which the load signal is once fed back proportionally to the regulation and at other time is coupled with a time delay to the regulation.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a schematic diagram of a condition regulator according to this invention;

FIG. 5 is a modification of the condition regulator of FIG. 4; and

DESCRIPTION OF THE PREFERRED EMBODIMENTS

Figure 1:
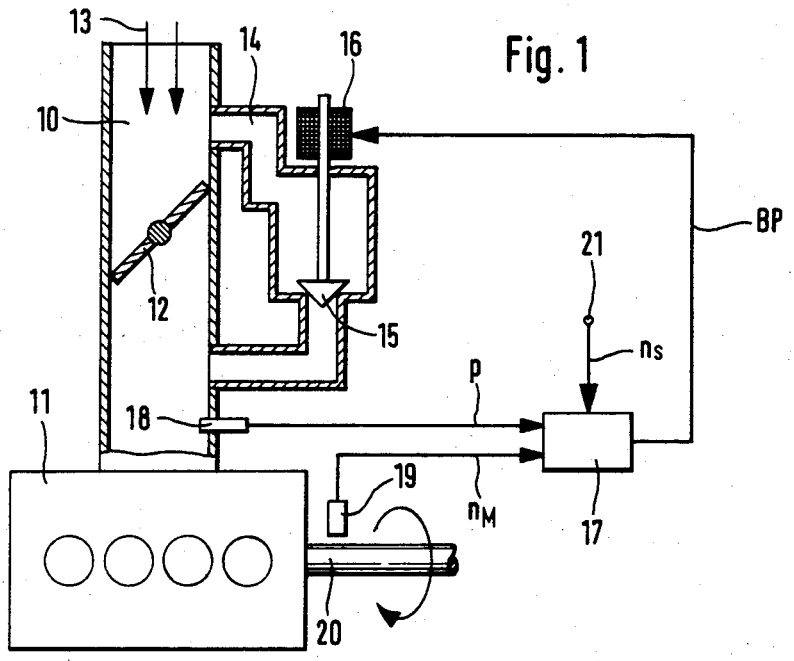
FIG. 1 shows schematically an arrangement of an embodiment of the regulating system for idling speeds of an engine, including a bypass valve.

Referring firstly to FIG. 1, reference numeral 10 designates a part of an induction pipe or intake manifold of an internal combustion engine 11, in which the fuel adjusting means includes a throttle valve 12 and a bypass valve 15. The supply of the fuel mixture is indicated by arrows 13. To regulate the idling speed there is provided a bypass conduit 14 communicating with the intake manifold 10 upstream and downstream of the throttle valve 12. A pilot or bypass valve 15 with a cone-shaped seat is arranged in the bypass conduit 14 and is controlled by a solenoid 16 so as to open or close the bypass conduit proportionally to a regulating signal BP delivered at the output of a regulator 17. The regulator has three inputs connected respectively to a pressure sensor 18, to a rotary speed detector 19, and to a generator 21 for the desired value of the rotary speed. The pressure sensor 18 is located in the intake manifold downstream of the throttle valve 12 and applies to the regulator a signal p indicative of the load of the engine. The speed detector 19 cooperates with the driving shaft 20 of the engine 11 and applies to the regulator a signal $n_M$ indicative of the actual rotary speed. The desired signal transmitter 21 applies to the regulator a desired value signal $n_S$.

In regulating the idling speed of the IC engine 11, the throttle valve 12 is normally closed, and the bypass valve 15 in the bypass conduit 14 is adjusted by means of solenoid 16 in such a manner that the actual idling speed corresponds to the desired value signal $n_S$. In addition, as will be explained below, the regulator 17 produces its output signal BP for the solenoid 16 by combining the signals $n_M$ and $n_S$ with the signal p indicative of the load of the engine. In this example, the signal p is the dynamic pressure measured downstream of the throttle valve 12, but it will be understood that also other signals indicative of the load of the engine, such as a torque signal, can be used for this purpose.

Figure 2:
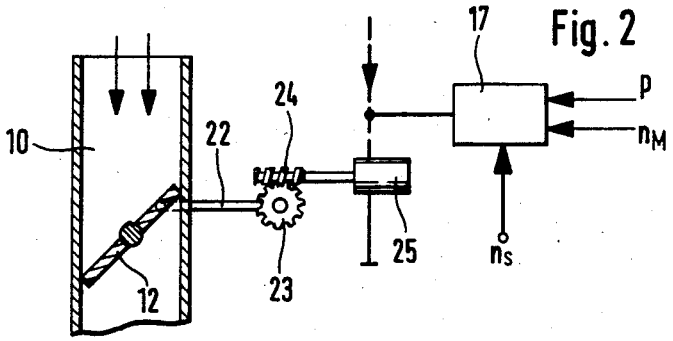
FIG. 2 shows schematically another embodiment of the system of this invention, including a motor driven adjusting means for the throttle valve.

In another embodiment, the regulation of the idling speed of the engine can be made by means of an electromotive adjustment of the throttle valve 12, as illustrated in FIG. 2. In this embodiment, the bypass conduits with valve 15 are dispensed with. In the embodiment of FIG. 2, the throttle valve 12 is connected via a shaft 22 to a worm gear 23 meshing a worm 24 at the output shaft of an electromotor 25. The arrangement of regulator 17 is the same as in the embodiment of FIG. 1, and the output signal BP from the regulator energizes the electromotor 25. In normal running condition of the engine, the throttle valve 12 is controlled either directly by means of a non-illustrated gas pedal or indirectly via the electromotor 25 by means of a non-illustrated servo mechanism indicated by the dashed arrow. Only in the case of a no-load rotary speed of the engine, the rate of rotations is regulated by adjusting the position of the throttle valve 12 in response to the output signal from the regulator 17.

Figure 3:
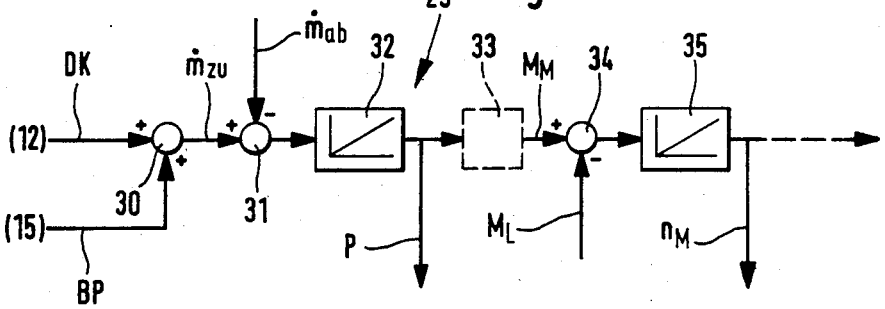
FIG. 3 is a schematic diagram of the operation of the system of this invention.

An operational model of the regulating system including the condition regulator according to this invention is schematically illustrated in FIG. 3 in relation to the output of the internal combustion engine. The adjusting elements for the input values are the throttle valve 12 and the bypass valve 15 responsive respectively to signals DK and BP. The latter signals are added to one another in a first summer 30, and the resulting signal $\dot{m}_{zu}$ indicates the ratio of the incoming air mass/time. In a second summer 31 a signal $\dot{m}_{db}$ which indicates the velocity or ratio of the past off air mass/time is subtracted from the signal $\dot{m}_{zu}$ in a second summer 31. The resulting air velocity or the ratio of the air mass/time at the output of the second summer 31 is integrated in the course of regulation as indicated in the first integrator 32. The resulting integrated value is manifested as the dynamic pressure p representing reliable information about the load of the engine. In a further stage of the regulating process, indicated by the dashed box 33 and which is of no interest in this context, a motor torque $M_M$ will result from the pressure p. From the motor moment $M_M$ is subtracted in a third summer 34 the momentary load $M_L$ of the engine, the latter value including also the additional loads of the engine caused for example by larger consumers. The resulting moment at the output of the third summer 34, in combination with the effective moment of inertia, is integrated in a second integrator 35 and determines the rotary speed $n_M$ of the engine.

The above described regulation 29 of interaction between the fuel mixture adjusting means and the IC engine is an operational model of the engine in which from the standpoint of regulating techniques two essential condition values occur. The two condition values are those at the output of respective integrators 32 and 35. An ideal condition regulator processes the values "pressure p" and actual "rotary speed of the engine $n_M$". It will be readily seen from the model depicted in FIG. 3 that the condition value p is available at a substantially earlier stage than the value $n_M$ (rotary speed), and consequently the utilization of the value p leads to a substantially more effective solution, inasmuch as variations in the system 29 of regulation can be detected much earlier and applied for the regulation.

The design of the condition regulator of the invention is depicted in principle in the functional diagram in FIG. 4.

The desired speed value signal $n_s$ from the transmitter 21 is applied via a proportional stage 40 to a fourth summer 41, the output of which produces the signal BP for the regulation system 29 (FIG. 3). The regulation system 29 is influenced by various operational conditions, such as for example the angular position of the throttle valve, the gradient of roadway, the parameters of the motor vehicle, the number of employed consumers in the vehicle, the air pressure, and the like. These operational conditions are indicated by arrows. The two essential condition values, as explained above in connection with FIG. 3, are the values p and $n_M$. The other input of the fourth summer 41 is connected to the output of a fifth summer 42 which in this example has three inputs. The first, non-inverting input is supplied via a proportional stage 43 with the value $n_m$ (actual rotary speed of the engine); the second input, which is also non-inverting is supplied via a proportional stage 44 with the value p (pressure); and the third, inverting input is supplied with the value p via a delaying stage 45. Due to the fact that the fifth summer 42 is connected to an inverting input of the third summer 41, the proportional stages 43 and 44 act together as a reverse or negative feedback, and the delaying stage 45 acts as a positive feedback. If desired, a characteristic curve setting stage 57 can be assigned to the delaying stage 45 to set the time-constant of the latter in dependence on the desired value signal $n_s$, the rotary speed $n_m$ of the engine and on the position s of a non-illustrated switch.

When the motor vehicle is stationary and the engine is idling, the rotary speed is steadily regulated substantially via the proportional stage 43 to the value of the desired rotary speed. If under such operational conditions a power-intensive consumer is added to the load of the engine, a drop of the rotary speed will take place, and simultaneously an increase of the pressure value p will result. Accordingly, the output signal at the output of the fifth summer 42 is immediately decreased via the proportional stage 43, on the one hand, and a time-delayed additional decrease of this output signal is caused by the delaying circuit 45. This decrease of the output signal causes an increase of the regulating signal BP at the output of the fourth summer 41, which in turn causes an increase in the fuel supply to the engine. In doing so, the absolute pressure p is simultaneously decreased, and the rotary speed of the engine is increased until a steady desired value of the rotary speed is reestablished.

When, in another operational condition, the motor vehicle pulls up at released gas pedal at which the throttle valve is closed, the condition regulator via the stage 43 is at its limit, inasmuch as the rotary speed exceeds the desired value and the absolute pressure p, due to the high rotary speed of the engine, considerably drops. In this case, however, the reduced absolute pressure p is made effective via the additional proportional stage 44, so that irrespective of the excessive rotary speed a certain opening of the regulating valve is guaranteed and the motor receives a corresponding supply of fuel mixture. If the positive coupling between the motor and the driven shaft is suddenly interrupted by releasing the clutch, the rotary speed of the motor at the same time steeply decreases and the absolute pressure p rapidly goes up. This oppositely directed developments are compensated as seen in proportional stages 43 and 44, whereas the time-delayed positive feedback via the stage 45 is initially ineffective. Conjointly, the stages 43 through 45 maintain the rotary speed of the engine on the desired value without permitting due to the emptied intake pipe a further rotary speed drop below the possible running limit of the engine as is the case with prior-art regulators operating exclusively with the speed values. The response of the regulating system to the falling of rotary speed due to turning on additional loads can be additionally improved, by controlling the time-constant of the positive feedback stage 45 of the pressure value p. A suitable approach for realizing this control is the determination of the time-constants as a generally non-linear function of the rotary speed $n_m$, of the difference $n_s - n_m$ of the desired and the actual rotary speeds, or of the time variations of the two magnitudes. By means of these measures, a very stable and steady behavior of the regulating loop is achieved, and at the same time any sudden variations of the rotary speed due to transient loads are promptly compensated. In summary, the regulating system according to this invention is in the position to guarantee a reliable adherence to the desired rotary speed, both under transient and under steady-state operational conditions.

FIG. 5 illustrates in a block diagram a modification of the condition regulator according to this invention.

In this embodiment, the values of the rotary speed $n_m$ of the engine, desired rotary speed value $n_s$, as well as the absolute pressure p are again applied to proportional stages 40', 43' and 44', the outputs of which are connected to the corresponding inputs of a common summer 50. The absolute pressure p is again applied to a time-delaying stage 45', the output of which is connected via a stage 52 with a descending characteristic line to a mixing stage 52. The positive feedback of the time-delayed pressure signals is produced by the negative rate of the characteristic line in the stage 51. In the mixing stage 52, the positively coupled, time-delayed pressure signal and the negatively coupled pressure signal from the proportional stage 44' are mixed, either by addition or by multiplication. The function of the regulator of this embodiment corresponds essentially to the embodiment of FIG. 4, whereby the adjustment of the time-constant of the time-delaying circuit 45' indicated by the dashed connection line from the output of the proportional stage 43' to an input of the delaying stage 45'.

To neutralize small residual errors and particularly the tolerances of component parts which may interfere especially with the positive coupling between stages 45' and 51, there is provided an integrating branch and a proportional branch for the regulation of the rotary speed difference. To this end, there is provided an additional summer 53 in which a signal corresponding to the speed difference is created, and this difference signal is applied via an integrator 54 and a limiter 55 to a non-inverting input of the summer 50. At the same time, the difference signal is applied to a parallel-connected differentiator 56 to another non-inverting input of the summer 50. The integrator 54 and the differentiator 56 operate in a known manner, so as to compensate for residual errors or to improve the speed of response of the regulating circuit.

It will be understood that each of the elements described above, or two or more together, may also find a useful application in other types of constructions differing from the types described above.

Figure 6:
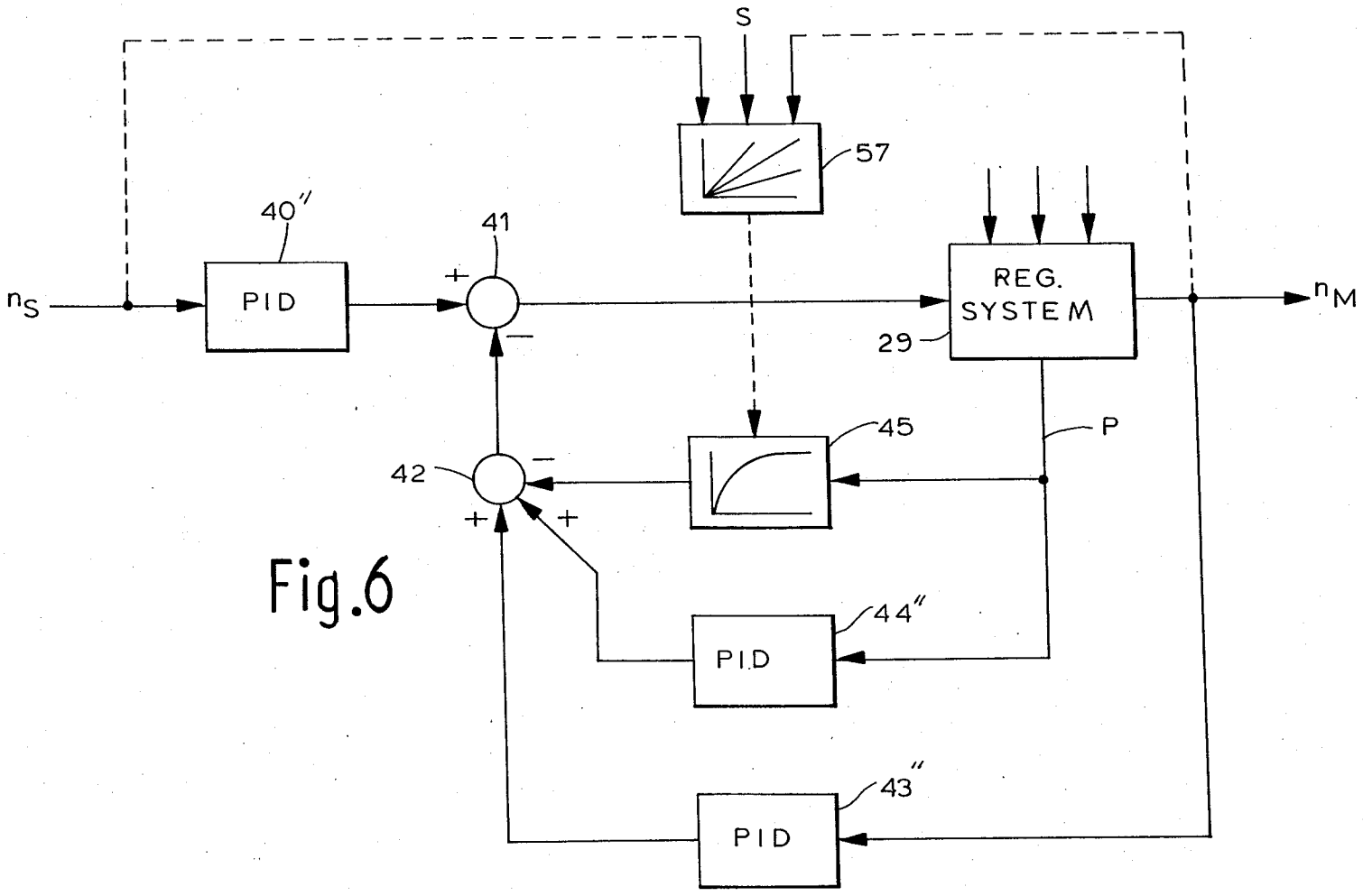
FIG. 6 is another modification of the condition regulator of FIG. 4.

While the invention has been illustrated and described as embodied in specific examples of a regulator for idle running of internal combustion engines, it is not intended to be limited to the details shown, since various modifications and structural changes may be made without departing in any way from the spirit of the present invention. For example, the feedback coefficients of the condition regulator in the proportional stages 40, 43 and 44 can be produced in other types of known elements, for example by means of PID members 40″, 43″ and 44″, as shown in FIG. 6.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A system for regulating rotary speed, particularly idling speed speed of an internal combustion engine, comprising means for generating a signal corresponding to a desired speed value; a sensor for generating an actual speed signal; an additional sensor for generating an additional signal corresponding to another operational variable of the engine; rotary speed adjusting means including a throttle valve arranged in an intake pipe of the engine and throttle valve control means; a condition regulator including two regulating branches each provided with a feedback, one regulating branch producing in response to a difference between the desired and actual rotary speed signals a first regulating signal, the other regulating branch producing, exclusively in response to said additional signal, a second regulating signal; and means for combining said first and second regulating signals to produce a compound regulating signal applied to said throttle valve control means, said one regulating branch including proportional stages for processing said desired and actual speed signals and means connected to said proportional stages for producing the difference of the latter signals, said other regulating branch including a proportional stage for processing said additional signal and a time-delayed stage acting as a positive feedback path of said additional signal, and a proportional stage in said one regulating branch and the proportional stage in the other regulating branch acting together as a negative feedback path of said actual speed signal.

2. A system as defined in claim 1, wherein the negative and positive feedback paths include PID stages.

* * * * *